US007543661B2

(12) United States Patent
Griffo et al.

(10) Patent No.: US 7,543,661 B2
(45) **Date of Patent: *Jun. 9, 2009**

(54) ROLLER CONE BITS WITH WEAR AND FRACTURE RESISTANT SURFACE

(75) Inventors: Anthony Griffo, The Woodlands, TX (US); Gregory Thomas Lockwood, Pearland, TX (US); Mohammed Boudrare, Houston, TX (US); Jiaqing Yu, Houston, TX (US)

(73) Assignee: Smith International, Inc., Houston, TX (US)

( * ) Notice: Subject to any disclaimer, the term of this patent is extended or adjusted under 35 U.S.C. 154(b) by 231 days.

This patent is subject to a terminal disclaimer.

(21) Appl. No.: 11/440,233

(22) Filed: May 23, 2006

(65) Prior Publication Data

US 2007/0095577 A1 May 3, 2007

Related U.S. Application Data

(63) Continuation of application No. 10/650,268, filed on Aug. 28, 2003, now Pat. No. 7,048,080.

(51) Int. Cl.
*E21B 10/50* (2006.01)

(52) U.S. Cl. ..... 175/375; 175/426; 76/108.2

(58) Field of Classification Search ..... 175/374, 175/375, 406, 408, 434, 435; 76/108.2
See application file for complete search history.

(56) References Cited

U.S. PATENT DOCUMENTS

| | | | | |
|---|---|---|---|---|
| 6,206,115 | B1 * | 3/2001 | Overstreet et al. | 175/374 |
| 6,571,889 | B2 * | 6/2003 | Griffo et al. | 175/371 |
| 6,615,935 | B2 * | 9/2003 | Fang et al. | 175/374 |
| 7,048,080 | B2 * | 5/2006 | Griffo et al. | 175/375 |

* cited by examiner

*Primary Examiner*—William P Neuder
(74) *Attorney, Agent, or Firm*—Connolly Bove Lodge & Hutz LLP

(57) ABSTRACT

Roller cone bits of this invention include a steel bit body having at least one leg extending therefrom. A steel cone is rotatably disposed on the leg. The steel cone includes a plurality of steel cutting elements that each project outwardly a distance therefrom. At least one of the cutting elements comprises a steel base portion that is integral with the cone and that projects a distance therefrom. A cutting element end portion is attached to the base portion and extends therefrom to form a tip of the cutting element. The base and end portions are permanently attached together when the cone and base are in a preexisting rigid state. The cutting element end portion is formed from a wear resistant material having a material microstructure comprising a first phase of grains selected from the group of carbides, borides, nitrides, and carbonitrides of W, Ti, Mo, Nb, V, Hf, Ta, and Cr refractory metals; and a second phase of a binder material selected from the group consisting of Co, Ni, Fe, and alloys thereof.

7 Claims, 10 Drawing Sheets

FIG. 3
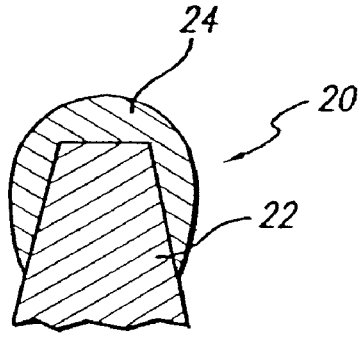
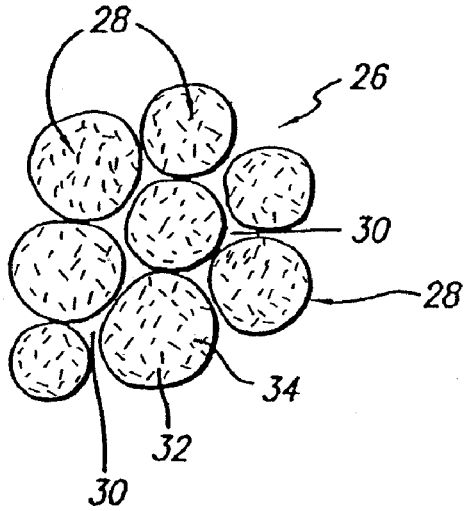
FIG. 4
FIG. 5
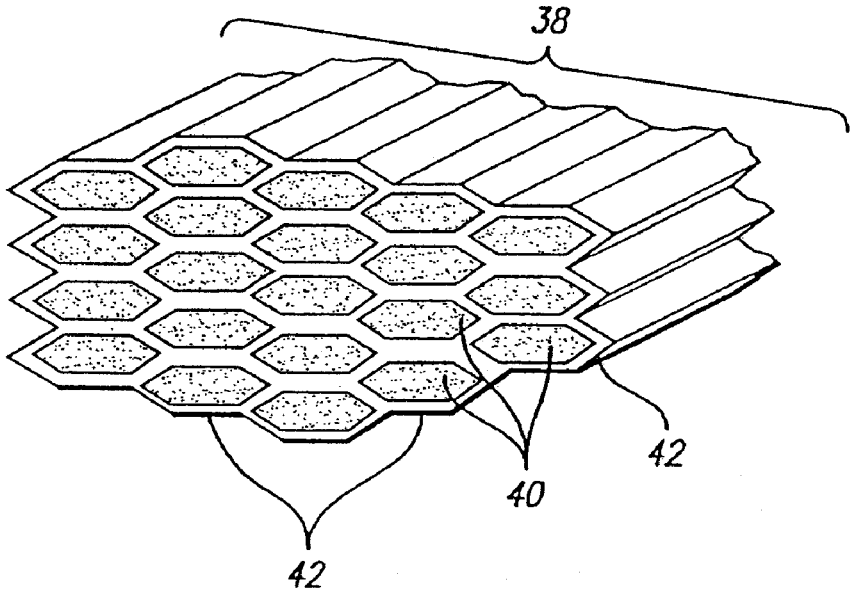

FIG. 10
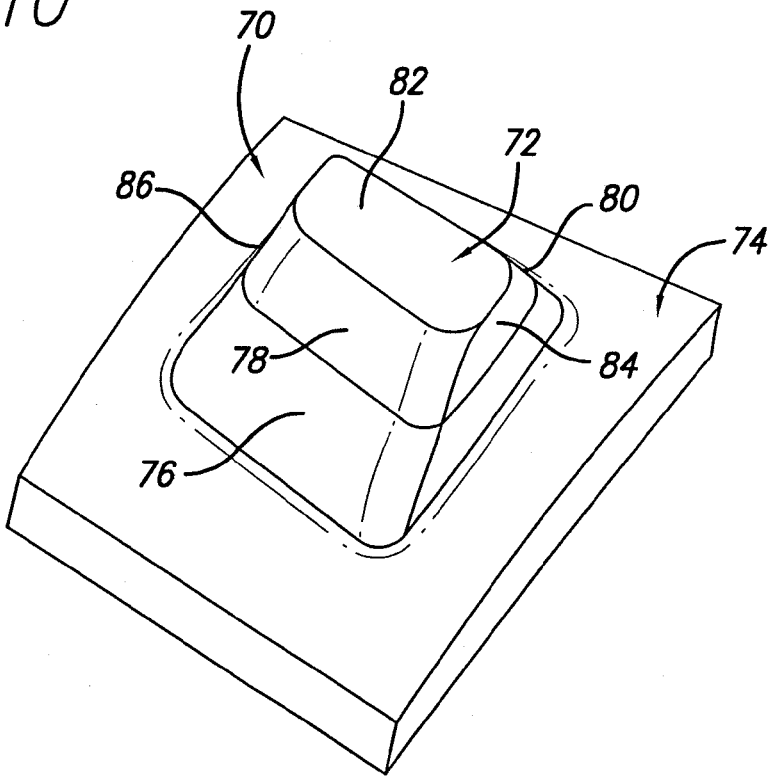
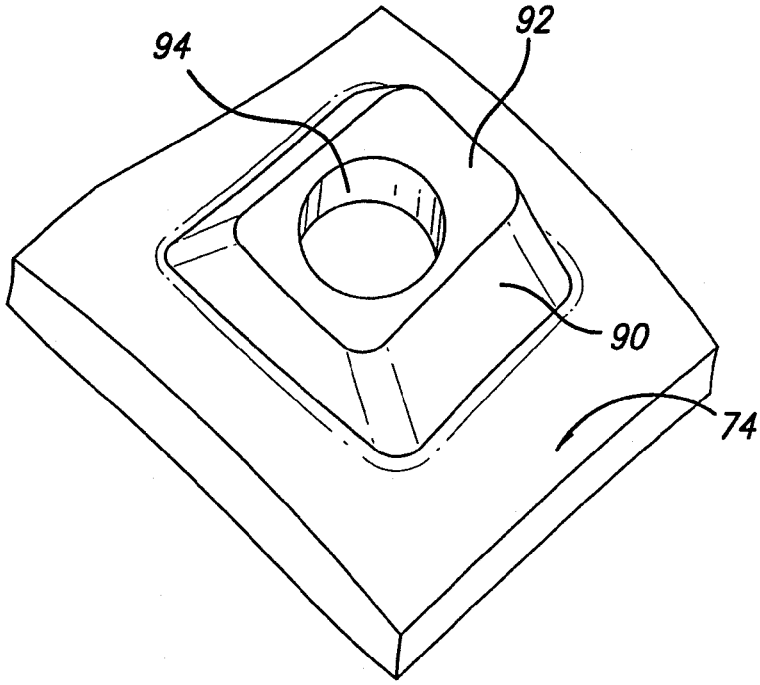
FIG. 11

FIG. 12
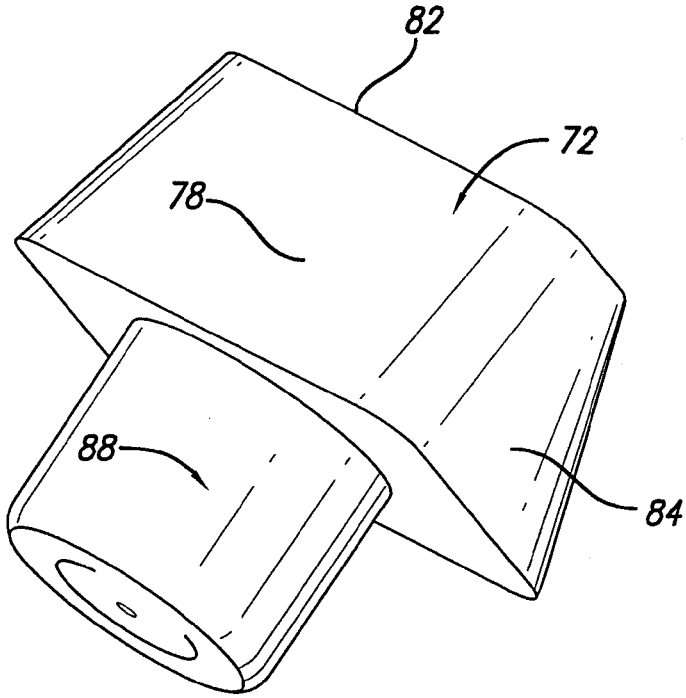
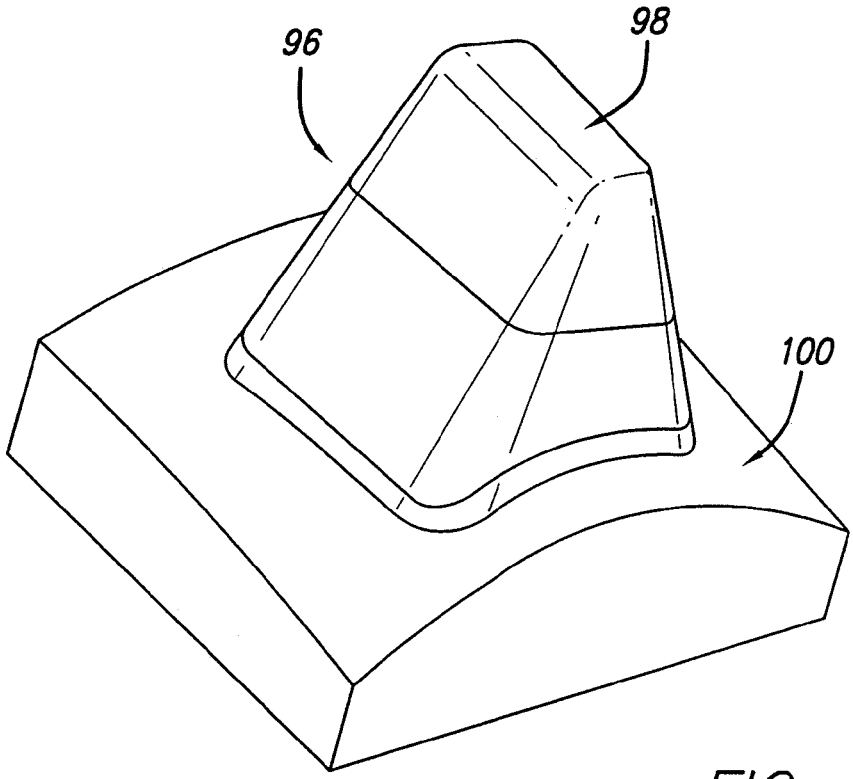
FIG. 13

FIG. 14
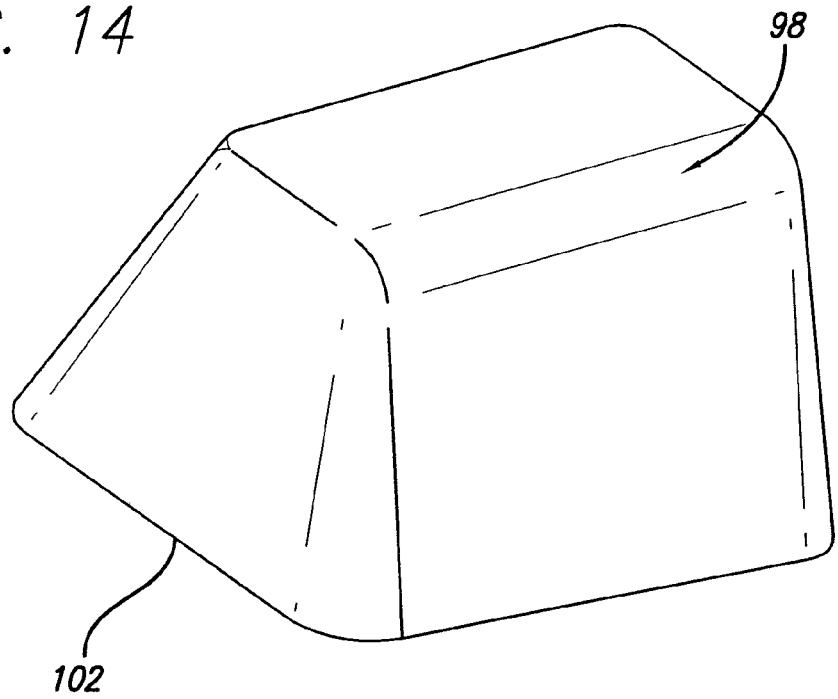
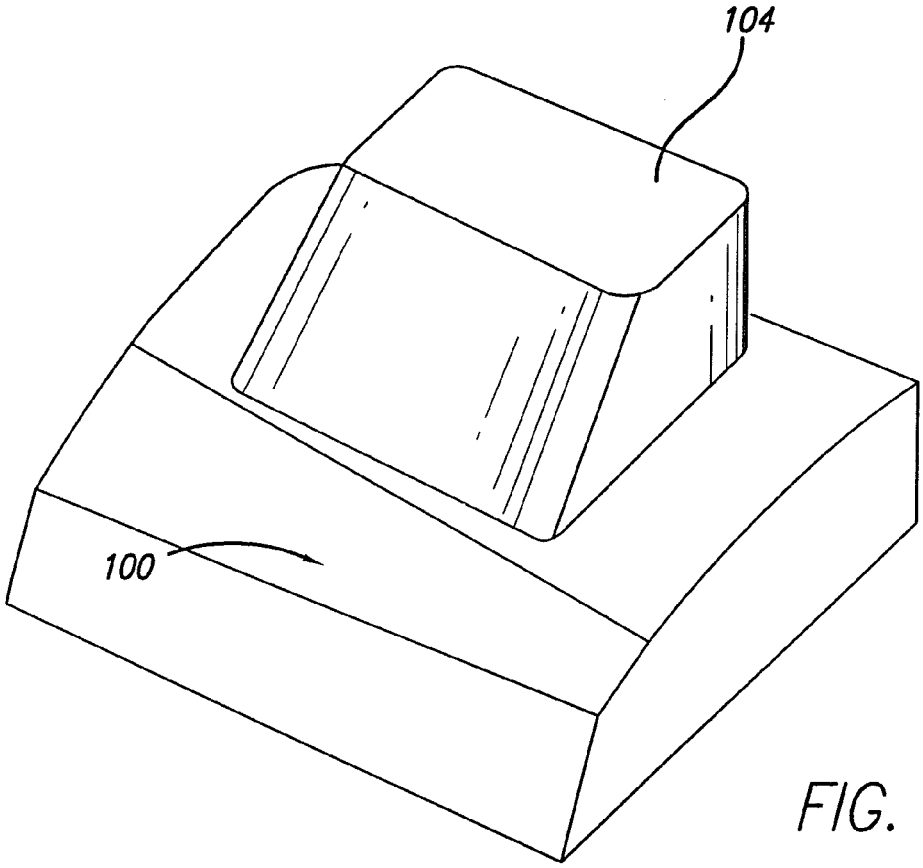
FIG. 15

FIG. 16
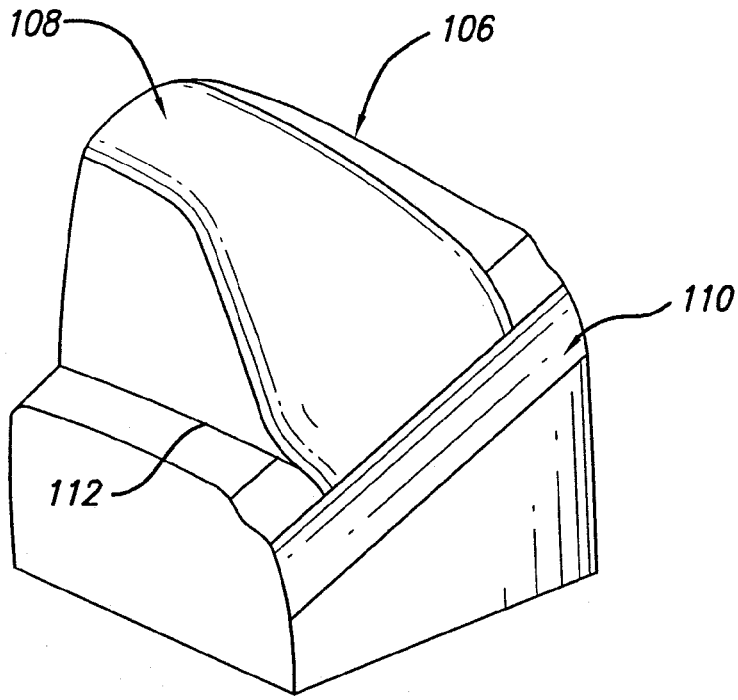
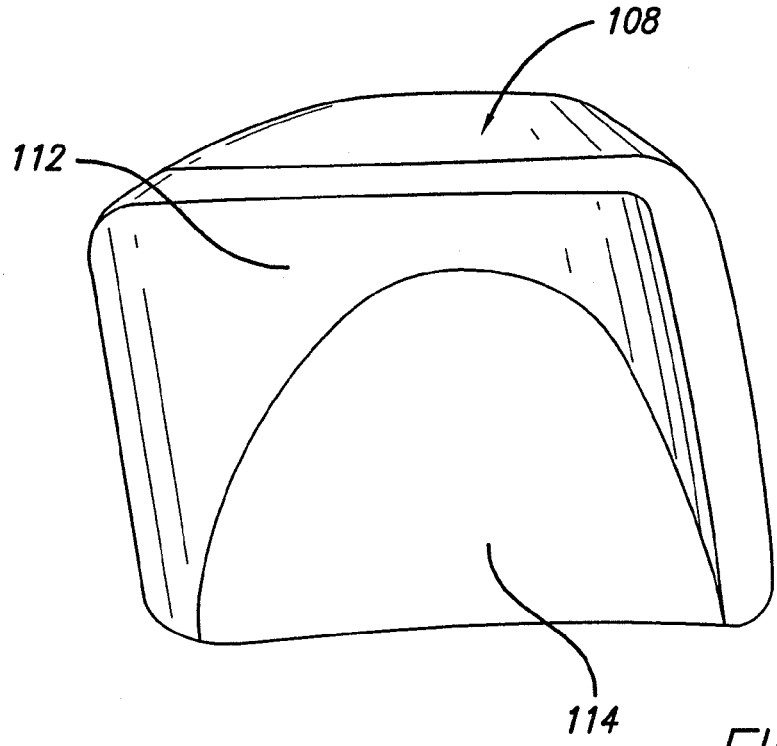
FIG. 17

FIG. 18
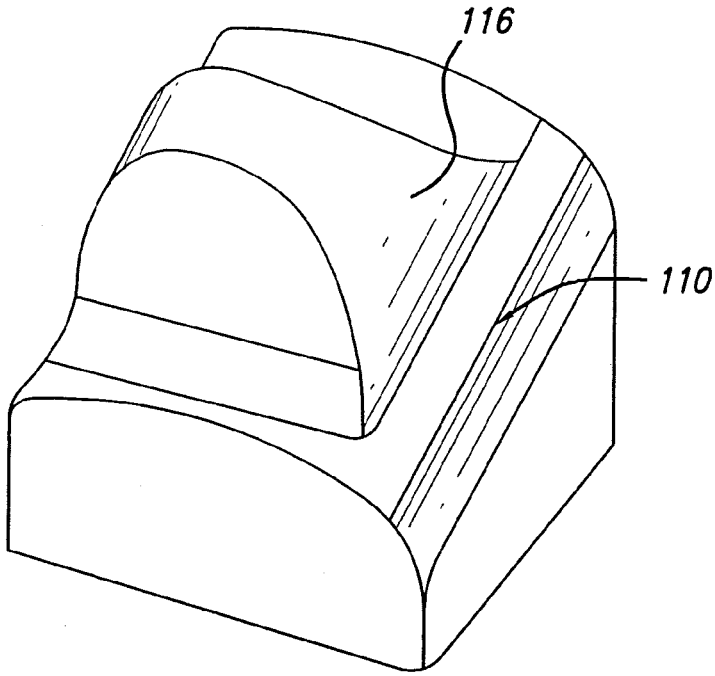
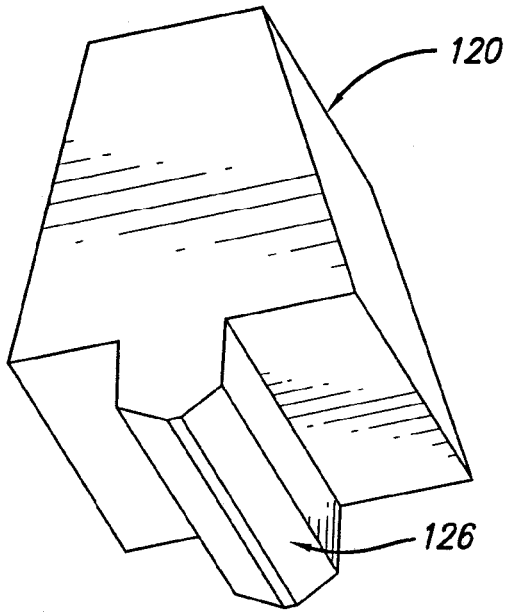
FIG. 20

ROLLER CONE BITS WITH WEAR AND FRACTURE RESISTANT SURFACE

RELATION TO COPENDING PATENT APPLICATION

This application is a continuation of U.S. patent application Ser. No. 10/650,268 filed on Aug. 28, 2003.

FIELD OF THE INVENTION

This invention relates to roller cone bits useful for subterranean drilling and, more particularly, to roller cone bits having a surface formed from composite cermet and/or cermet materials that are designed to provide improved properties of wear and fracture resistance, and thereby providing extended bit service life, when compared to conventional hardfaced bits.

BACKGROUND OF THE INVENTION

Rock bits used for drilling oil wells and the like commonly have a steel body that is connected at the bottom of a drill string. Steel cutter cones are mounted on the body for rotation and engagement with the bottom of a hole being drilled to crush, gouge, and scrape rock for drilling the well. One important type of rock bit, referred to as a "milled tooth" bit, has roughly trapezoidal teeth protruding from the surface of the cone for engaging the rock. The principal faces of such milled teeth that engage the rock are usually hardfaced with a layer of material that is designed to resist wear.

The term "hardfaced" is understood in industry to refer to the process of applying a carbide-containing steel material (i.e., conventional hardmetal) to the underlying steel substrate by welding process, as is better described below. Thus, the terms "hardfaced layer" or "hardfacing" are understood as referring to the layer of conventional hardmetal that is welded onto the underlying steel substrate.

Conventional hardmetal materials used to provide wear resistance to the underlying steel substrate usually comprises pellets or particles of cemented tungsten carbide (WC—Co) and/or cast carbide particles that are embedded or suspended within a steel matrix. The carbide materials are used to impart properties of wear resistance and fracture resistance to the steel matrix. Conventional hardmetal materials useful for forming a hardfaced layer on bits may also include one or more alloys to provide one or more certain desired physical properties. As mentioned above, the hardfaced layer is bonded or applied to the underlying steel teeth by a welding process.

The hardfaced layer is conventionally applied onto the milled teeth by oxyacetylene or atomic hydrogen welding. The hardfacing process makes use of a welding "rod" or stick that is formed of a tube of mild steel sheet enclosing a filler which is made up of primarily carbide particles. The filler may also include deoxidizer for the steel, flux and a resin binder. The relatively wear resistant filler material is typically applied to the underlying steel tooth surface, and the underlying tooth surface is thus hardfaced, by melting an end of the rod on the face of the tooth. The steel tube melts to weld to the steel tooth and provide the matrix for the carbide particles in the tube. The deoxidizer alloys with the mild steel of the tube.

While this hardfacing process is effective for providing a good bond between the steel substrate and the conventional hardmetal material, it is a relatively crude process that is known to adversely impact the performance properties of the hardfaced layer. The hardfacing welding process itself generates certain welding byproducts that can and does enter the applied material to produce an inconsistent material microstructure. For example, the welding process is known to introduce oxide inclusions and n-phases into the applied material, which function to disrupt the desired material microstructure. Such disruptions or inconsistencies in the material microstructure are known to cause premature chipping, flaking, fracturing, and ultimately failure of the hardfaced layer. Additionally, the welding process and associated thermal impact of the same can cause cracks to develop in the material microstructure, which can also cause premature chipping, flaking, fracturing, and ultimately failure of the hardfaced layer.

Additionally, the hardfacing process of welding the carbide-containing steel material onto the underlying substrate makes it difficult to provide a hardfaced layer having a consistent coating thickness, which ultimately governs the rate of wear loss for the steel material, and the related service life of bit.

Example conventional hardmetal materials, useful for forming a conventional hardfaced layer, typically comprise in the range of from about 30 to 40 percent by weight steel, and include carbide pellets and/or particles having a particle size in the range from about 200 to 1,000 micrometers. Examples of conventional materials used for forming hardfaced layers can be found in U.S. Pat. Nos. 4,944,774; 5,663,512; and 5,921,330.

The combination of relatively high steel content and large carbide particle size for such conventional hardmetal materials dictate that the mean spacing between the carbide pellets within the steel matrix be relatively large, e.g., greater than about 10 micrometers. It is believed that this relatively large mean spacing of carbide particles within the conventional hardmetal material causes preferential wear of the steel matrix that is known to lead to uprooting and removal of the carbide particles. Such wear loss is known to occur along the milled tooth tip at high stress locations during drilling and functions to accelerate loss of the hardfacing, which is a predominant failure mechanism for hardfaced bit surfaces, thereby limiting the service life of such bits.

It is, therefore, desirable that a wear and fracture resistant material, and method for applying the same, be developed for use on a surface of a rock bit that avoids the undesired effects of hardfacing, e.g., that avoids the undesired impact on the material microstructure due to the thermal effect and introduction of unwanted byproducts inherent in the welding process, that can adversely impact rock bit surface performance properties. It is also desirable that such wear and fracture resistant material be designed and/or applied onto the surface of a rock bit in such a manner as to provide improved properties of dimensional consistency and accuracy, e.g., a substantially consistent wear resistant surface thickness, when compared to conventional hardfaced materials. It is also desired that such wear and fracture resistant material be engineered in such a manner as to avoid the problem of preferential wear loss that is inherent to conventional hardmetal materials. Thus, it is desired that wear and fracture resistant materials, and methods for applying the same, according to principles of this invention, provide rock bit surfaces that display improved properties of wear and fracture resistance, when compared to conventional hardfaced rock bits, to provide prolonged rock bit service life.

SUMMARY OF THE INVENTION

Wear and fracture resistant materials useful for providing wear resistant rotary cone rock bits surfaces are prepared according to the principles of this invention. Rotary cone bits of this invention generally include a steel bit body having at least one leg extending therefrom. A steel cone is rotatably disposed on the leg. The steel cone includes a plurality of steel cutting elements that each project outwardly a distance therefrom.

At least one of the cutting elements comprises a steel base portion that is integral with the cone and that projects a distance therefrom. A cutting element end portion is attached to the base portion and extends therefrom to form a tip of the cutting element. In a preferred embodiment, the end portion is substantially solid. The base and end portions are permanently attach together when the cone and base are in a preexisting rigid state.

The cutting element end portion is formed from a wear resistant material having a material microstructure comprising a first phase of grains selected from the group of carbides, borides, nitrides, and carbonitrides of W, Ti, Mo, Nb, V, Hf, Ta, and Cr refractory metals; and a second phase of a binder material selected from the group consisting of Co, Ni, Fe, and alloys thereof. The end portion can be attached to the base while in a green state, in which case the end portion is consolidated and sintered after being placed onto the base, or can be attached to the base after its has been sintered, in which case it is attached to the base by brazing process. Additionally, the cutting element end and base portions can have interfacing surfaces that are specifically designed to include complimentary configured features to facilitate assembly and attachment of the portions.

Rock bits comprising wear and fracture resistant surfaces, prepared according to principles of this invention, have material microstructures that are free of unwanted byproducts associated with conventional hardfacing, have improved properties of dimensional consistency and accuracy, do not display preferential wear loss when compared conventional hardmetal materials. Rock bits comprising wear and fracture resistant surfaces of this invention display improved properties of wear and fracture resistance, when compared to conventional hardfaced rock bits, thereby providing prolonged rock bit service life.

DESCRIPTION OF THE DRAWINGS

These and other features and advantages of the present invention will be appreciated as the same becomes better understood by reference to the following detailed description when considered in connection with the accompanying drawings wherein:

FIG. 3 is a cross sectional side view of a tooth comprising a wear and fracture resistant composite cermet material surface according to first and third embodiments of this invention;

FIG. 4 is a schematic representation of a material microstructure of a wear and fracture resistant composite cermet material surface according to principals of this invention;

FIG. 5 is a schematic representation of a material microstructure of a wear and fracture resistant composite cermet material surface according to principals of this invention;

FIG. 10 is a perspective view of a tooth implant embodiment of this invention mounted to a portion of a milled tooth rock bit;

FIG. 11 is a perspective view of the tooth implant embodiment of FIG. 10;

FIG. 12 is a perspective view of a portion of the milled tooth rock bit of FIG. 10 used to accommodate attachment of the tooth implant embodiment of FIG. 11;

FIG. 13 is a perspective view of another tooth implant embodiment of this invention mounted to a portion of a milled tooth rock bit;

FIG. 14 is a perspective view of the tooth implant embodiment of FIG. 13;

FIG. 15 is a perspective view of a portion of the milled tooth rock bit of FIG. 13 used to accommodate attachment of the tooth implant embodiment of FIG. 14;

FIG. 16 is a perspective view of another tooth implant embodiment of this invention mounted to a portion of a milled tooth rock bit;

FIG. 17 is a perspective view of the tooth implant embodiment of FIG. 16;

FIG. 18 is a perspective view of a portion of the milled tooth rock bit of FIG. 16 used to accommodate attachment of the tooth implant embodiment of FIG. 15;

FIG. 20 is a perspective view of the tooth implant embodiment of FIG. 19.

DETAILED DESCRIPTION OF THE INVENTION

Roller cone rock bits of this invention comprise surfaces formed from functionally-engineered wear and fracture resistant materials. The wear and fracture resistant material is generally disposed onto an underlying steel milled tooth or bit surface without using a conventional hardfacing application process, i.e., without welding. Rock bits of this invention can comprise one or more layers of wear and fracture resistant materials disposed over a steel milled tooth or bit surface to provide improved properties of wear and fracture resistance. Such functionally-engineered wear and fracture resistant materials are applied by methods that avoid the undesired impact on the material microstructure inherent with conventional hardfacing application method, i.e., that avoids the introduction of unwanted byproducts or thermal effects inherent with welding, and that avoids dimensional inconsistencies.

Generally speaking, wear and fracture resistant materials used to provide wear and fracture resistant surfaces to rock bits have functionally-engineered random or oriented material microstructures designed to provide wear and fracture resistant properties tailored for particular applications. These materials can be in the form of cermets and/or composite cermets that are functionally engineered, in terms of the material constituents and/or final material microstructure, to provide superior properties of wear and fracture resistance when compared to conventional hardmetal materials. Thus, the composite cermet and cermet wear and fracture resistant materials of this invention act to overcome the failure mechanism discussed above of material wear loss associated with hardfaced layers formed from conventional hardmetal materials.

Figure 1:
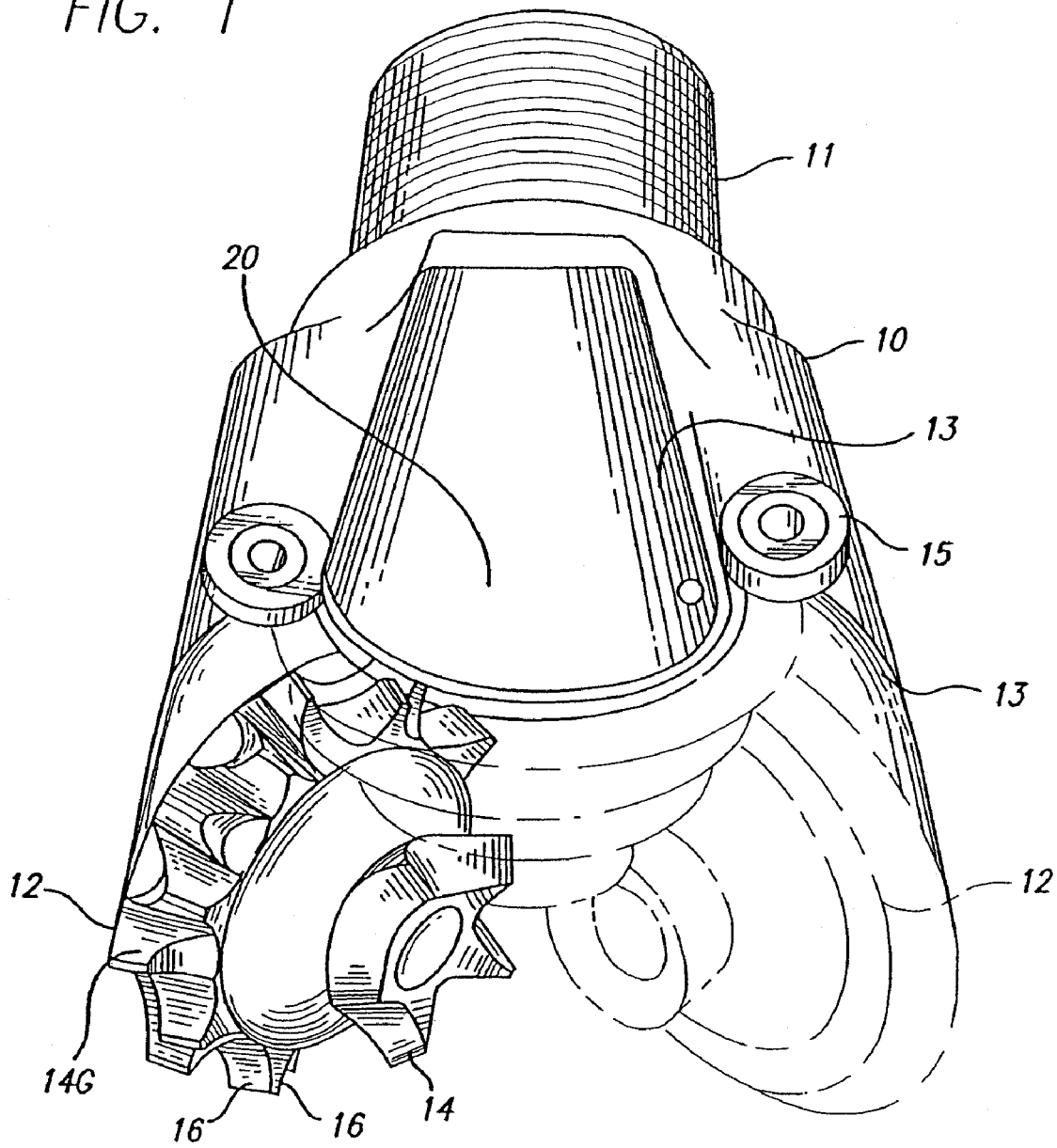
FIG. 1 is a perspective view of a milled tooth rock bit constructed according to principles of this invention.

FIG. 1 illustrates an exemplary milled tooth rock bit comprising a stout steel body 10 having a threaded pin 11 at one end for connection to a conventional drill string. At the opposite end of the body there are three cutter cones 12 for drilling rock for forming an oil well or the like. Each of the cutter cones is rotatably mounted on a pin (hidden) extending diagonally inwardly on one of the three legs 13 extending downwardly from the body of the rock bit. As the rock bit is rotated by the drill string to which it is attached, the cutter cones effectively roll on the bottom of the hole being drilled. The cones are shaped and mounted so that as they roll, teeth 14 on the cones gouge, chip, crush, abrade, and/or erode the rock at the bottom of the hole. The teeth 14G in the row around the heel of the cone are referred to as the gage row teeth. They engage the bottom of the hole being drilled near its perimeter on "gage." Fluid nozzles 15 direct drilling mud into the hole to carry away the particles of rock created by the drilling.

Such a rock bit is conventional and merely typical of various arrangements that may be employed in a rock bit. For example, most rock bits are of the three cone variety illustrated. However, one, two and four cone bits are also known. The arrangement of teeth on the cones is just one of many possible variations. In fact, it is typical that the teeth on the three cones on a rock bit differ from each other so that different portions of the bottom of the hole are engaged by the three cutter cones so that collectively the entire bottom of the hole is drilled. A broad variety of tooth and cone geometries are known and do not form a specific part of this invention.

Figure 2:
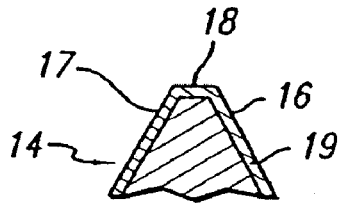
FIG. 2 PRIOR ART
FIG. 2 is a fragmentary cross section of a prior art hardfaced tooth from a milled tooth rock bit.

FIG. 2 illustrates a prior art milled tooth 14 having a generally trapezoidal cross section when taken from a radial plane of the cone. Such a tooth has a leading flank 16 and trailing flank 17 meeting in an elongated crest 18. The flanks of the teeth are covered with a hardfaced layer 19.

The leading face of the tooth is the face that tends to bear against the undrilled rock as the rock bit is rotated in the hole. Because of the various cone angles of teeth on a cutter cone relative to the angle of the pin on which the cone is mounted, the leading flank on the teeth in one row on the same cone may face in the direction of rotation of the bit, whereas the leading flank on teeth in another row may, on the same cone, face away from the direction of rotation of the bit. In other cases, particularly near the axis of the bit, neither flank can be uniformly regarded as the leading flank and both flanks may be provided with a hardfaced layer.

There are also times when the ends of a tooth, that is, the portions facing in more or less an axial direction on the cone, are also provided with a hardfaced layer. This is particularly true on the so-called gage surface of the bit which is virtually always provided with hardfaced layer. The gage surface is a generally conical surface at the heel of a cone which engages the side wall of a hole as the bit is used. The gage surface includes the outer end of teeth 14G (see FIG. 1) in the so-called gage row of teeth nearest the heel of the cone and may include additional area nearer the axis of the cone than the root between the teeth. The gage surface is not considered to include the leading and trailing flanks of the gage row teeth. The gage surface encounters the side wall of the hole in a complex scraping motion which induces wear of the gage surface. In some embodiments, the hardfaced layer may also be applied on the shirttail 20 (see FIG. 1) at the bottom of each leg on the bit body.

The basic structure of a milled tooth rock bit is well known and does not form a specific portion of this invention, which relates to bits having wear resistant composite material surfaces, and methods for forming the same.

Generally speaking, for the effective use of a rock bit, it is important to provide as much wear resistance as possible on the teeth of a rock bit cutter cone. The effective life of the cone is enhanced as wear resistance is increased. It is desirable to keep the teeth protruding as far as possible from the body of the cone since the rate of penetration of the bit into the rock formation is enhanced by longer teeth (however, unlimited length is infeasible since teeth may break if too long for a given rock formation). As wear occurs on the teeth, they get shorter and the drill bit may be replaced when the rate of penetration decreases to an unacceptable level. It is, therefore, desirable to minimize wear so that the footage drilled by each bit is maximized. This not only decreases direct cost, but also decreases the frequency of having to "round trip" a drill string to replace a worn bit with a new one.

Due to the unique wear encountered on the gage surfaces of the cone and teeth along the hole wall, it is desired that a composite material and method for applying the same be developed for use in providing improved wear resistance and abrasion protection for such gage surfaces, and for other non-gage teeth surfaces as well. As gage teeth and gage surfaces wear, the diameter of the hole drilled by the bit may decrease, sometimes causing drilling problems or requiring "reaming" of the hole by the next bit used. Advances in wear resistance of the cone and/or teeth wear surfaces is desirable to increase the duration during which a hole diameter (or gage) can be maintained, to enhance the footage a drill bit can drill before becoming dull, and to enhance the rate of penetration of such drill bits. Such improvements translate directly into reduction of drilling expense.

Rock bits comprising wear and fracture resistant composite cermet and/or cermet materials, prepared according to principles of this invention, provide improved properties of wear and fracture resistance to those surfaces of the rock bit, e.g., the teeth on the cutter cones, subjected to the most extreme wear conditions, thereby reducing material loss and extending the effective service life of rock bits comprising the same.

FIG. 3 illustrates a first embodiment of this invention 20 comprising a cutting element in the form of a steel tooth substrate 22, taken from a milled tooth rock bit as illustrated in FIG. 1, having a wear and fracture resistant material surface 24 disposed thereon. The composite material 24 can be applied either to the entire surface of the underlying substrate or to a select portion of the underlying substrate, depending on the particular cutting element and/or bit geometry and drilling application. In an example embodiment, the material 24 is applied along a surface portion of the substrate that is subjected to high levels of stress during the drilling operation, e.g., the leading faces and/or the axial ends of the cutting element, e.g., teeth.

While materials of this invention are illustrated in FIG. 3 as being disposed onto at least a portion of a cutting element, it is to be understood that wear and fracture resistant materials used in both this particular embodiment and in the many embodiments of this invention can be applied to bit surfaces other than or in combination with the teeth, depending on the particular bit application. For example, wear and fracture resistant materials can be applied to the cone shirt tail and/or surfaces in between teeth on the cone shell in applications where abrasive wear may be a failure mode.

In such cases where the wear and fracture resistant materials are disposed onto a cone surface, it is to be understood that the material is disposed onto the rotary cone while the cone is already in a rigid state, i.e., is in a pre-existing rigid state. For example, rotary cones forming the substrate for wear and fracture resistant materials of this invention are either forged and machined from steel bars (i.e., in the form of wrought or casting stock) or are sintered from metal powders (i.e., in the form of a fully- or partially-densified substrate).

In an example first embodiment, the wear and fracture resistant material is a composite cermet. Referring to FIG. 4, as used in herein, the term "composite cermet" is intended to refer to a material having a microstructure 26 comprising a plurality of cermet first regions 28 distributed within a matrix of a second relatively more ductile region 30 that separates the first regions from one another. The term "cermet", as used herein, is understood to refer to those materials having both a ceramic and a metallic constituent. Each cermet first region 28 comprises a composite of hard grains 32 or particles and a ductile binder phase 34 bonding the particles together.

The hard grains 32 or particles can be selected from the group of carbides consisting of W, Ti, Mo, Nb, V, Hf, Ta, and Cr carbides. The ductile binder phase 34 can be selected from the group consisting of Co, Ni, Fe, alloys thereof, and alloys with materials selected from the group consisting of C, B, Cr, Si and Mn. Materials useful for forming the cermet first phase regions 28, e.g., WC—Co, can have an average particle size in the range from about 30 to 1,000 micrometers. The second ductile region 30 can be selected from the group consisting of steel, Co, Ni, Fe, W, Mo, Ti, Ta, V, Nb, alloys thereof, and alloys with materials selected from the group consisting of C, B, Cr, and Mn.

A preferred cermet first region 28 comprises tungsten carbide grains 32 that are cemented or bonded together with cobalt as the ductile binder phase 34, i.e., WC—Co. A preferred second ductile region 30 can be cobalt or steel. Such composite cermet material may comprise in the range of from 15 to 80 percent by volume of the second ductile region, e.g., cobalt or steel, and a remaining amount cermet first phase regions, e.g., WC—Co pellets. Composite cermet materials useful for forming functionally-engineered wear and fracture resistant materials, and methods for making the same, for use as surfaces on a milled tooth bit include but are not limited to the composite cermet materials as described in U.S. Pat. No. 5,880,382, which is incorporated herein by reference The types of materials that are selected to form the cermet first region and the second ductile region, the particle sizes of cermets used to form the cermet first regions, and the relative volume of cermet first regions used to form the above-described composite cermet material is understood to vary depending on the particular drilling application for milled tooth bits comprising wear and fracture resistant surfaces of this invention.

As an alternative to the composite cermet materials described above, wear and fracture resistant materials useful for forming rock bit surfaces of this invention can include a composite cermet having an ordered or oriented material microstructure of two of more different materials phases as described in U.S. Pat. No. 6,063,502. Referring to FIG. 5, composite cermet materials 38 having an ordered material microstructure comprise a cermet first structural region 40 comprising a hard material selected from the group consisting of cermet materials as described above. A second structural region 42 comprises a material that is different from that used to form the cermet first structural region 40 and is in contact with at least a portion of the first structural region. In an example embodiment, the material used to form the second structural region is a ductile materials such as steel, Co, Ni, Fe, W, Mo, Ti, Ta, V, Nb, and alloys thereof, and the second structural region is substantially continuous around the plurality of first structural regions. The ordered or oriented microstructure of such composite cermet material comprises repeated structural units each made up of the first and second structural regions.

The wear and fracture resistant materials useful for forming rock bit surfaces of this invention can be applied onto a desired underlying substrate according to at least two different methods. According to a first application method, the wear and fracture resistant materials are first preformed into a green part that is configured to fit over a desired rock bit surface, e.g., that is configured into the shape of a cap for placement over a milled tooth, or in the shape of a shell for placement over a cone surface. The green part is formed into the desired shape by mold process and is placed onto the intended substrate surface, e.g., a bit tooth surface.

A molding technique useful for forming a preformed green part of the wear and fracture resistant material comprises mixing together a desired steel and/or cermet or cermet precursor/constituent powder (useful for forming the desired composite cermet and/or cermet) with a suitable liquefying agent to form a semi-plastic mixture. Suitable composite cermet and/or cermet constituent material powders are the same as those described above.

Suitable liquefying agents useful for making wear and fracture resistant surfaces of this invention include those that are capable of blending with the material powder to form a substantially homogeneous mixture, and that can provide flexibility to the solid material (powder) to facilitate shaping and preforming. Additionally, the chosen liquefying agent should have a desirable burnout behavior, enabling it to be removed from the green part during subsequent processing without causing damage to the structure. Suitable liquefying agents include waxes, organic binders, and polymeric binders that are capable of both combining with the material constituent powders to form a solution, and being removed from the solution during further processing so that they do not impair formation of the desired composite material microstructure.

Example polymer binders include can include thermoplastic materials, thermoset materials, aqueous and gelation polymers, as well as inorganic binders. Suitable thermoplastic polymers may include polyolefins such as polyethylene, polyethylene-butyl acetate (PEBA), ethylene vinyl acetate (EVA), ethylene ethyl acetate (EEA), polyethylene glycol (PEG), polysaccharides, polypropylene (PP), poly vinyl alcohol (PVA), polystyrene (PS), polymethyl methacrylate, methylethyl ketone (MEK), poly ethylene carbonate (PEC), polyalkylene carbonate (PAC), polycarbonate, poly propylene carbonate (PPC), nylons, polyvinyl chlorides, polybutenes, polyesters, waxes, fatty acids (stearic acid), natural and synthetic oils (heavy mineral oil), and mixtures thereof. Suitable thermoset plastics useful as the polymer binder may include polystyrenes, nylons, phenolics, polyolefins, polyesters, polyurethanes. Suitable aqueous and gelation systems may include those formed from cellulose, alginates, polyvinyl alcohol, polyethylene glycol, polysaccharides, water, and mixtures thereof. Silicone is an example inorganic polymer binder.

In an example first method where the desired preformed green part is in the shape of a cap, the step of preforming involves taking the semi-plastic mixture and pressing, extruding, and chopping the extruded product into thin disks. Each disk is loaded into a press and is thermoformed into a final green product, e.g., a cap, for placement over at least a portion of a bit tooth by pressing under temperature conditions in the range of from 30 to 150 C. and under pressure conditions in the range of from 100 to 10,000 psi. In an example embodiment, the so-formed green part is in the shape of a cap that is placed over a bit tooth. Again, however, it is to be understood that the green part can be preformed into any shape necessary to cover a desired substrate surface. ???

The preformed green part is constructed having an accurately controlled and replicable layer thickness. For example, the above-described thermoforming process enables formation of green parts, e.g., caps, having a consistent layer thickness within a range of from 0.05 to 10 millimeters (mm). It is to be understood, however, that the layer thickness may vary from this range depending on such factors as the type of composite cermet and/or cermet materials selected, the location of the wear resistant material surface on the rock bit, and the particular rock bit drilling application.

The preformed green part is positioned over the intended substrate surface, is bonded to the substrate, and is sintered/consolidated by a pressure-assisted sintering process to form the final dense product that provides the desired properties of wear and fracture resistance. The green part can be sintered/consolidated by high-temperature/high-pressure processes known in the art. Other example sintering/consolidation processes useful for forming wear and fracture resistant surfaces of this invention include rapid omnidirectional compaction (ROC) process, hot pressing, infiltration, solid state or liquid phase sintering, hot isostatic pressing (HIP), pneumatic isostatic forging, and combinations thereof. These processes are desired because they are needed to form the desired wear and fracture resistant surface material microstructure comprising.

A preferred sintering/consolidation process is the ROC process. Exemplary ROC processes are described in U.S. Pat. Nos. 4,945,073; 4,744,943; 4,656,002; 4,428,906; 4,341,557 and 4,142,888, which are hereby incorporated by reference. The ROC process that may be used involves placing the green part, e.g., the substrate comprising the preformed green part, into a closed die and presintering it at a relatively low temperature to drive off the polymer binder and achieve a density appreciably below full theoretical density.

A special glass powder is loaded into the closed die with the presintered part. The glass powder has a lower melting point than that of the green part. The die is heated to raise the temperature to the desired consolidation temperature, which temperature is also above the melting point of the glass. For example, for a wear resistant composite cermet material comprising WC—Co, the consolidation temperature is in the range of from 1,000 C. to 1,500 C. The heated die is placed in a hydraulic press having a closed cylindrical die and ram that presses into the die. Molten glass and the green part are subjected to high pressure in the die. The part is isostatically pressed by the liquid glass to pressure as high as 120 ksi. The temperature capability of the entire process can be as high as 1,800 C. The high pressure is applied for a short period of time, e.g., less than about five minutes and preferably one to two minutes, and isostatically compacts the green part to essentially 100 percent density.

It is to be understood that the above-described sintering/consolidation process is but one method that can be used to form the final wear and fracture resistant surface from the green part, and that other sintering/consolidation methods can be used to achieve the same purpose within the scope of this invention.

As an alternative to applying the preformed green part onto the substrate and subsequently sintering/consolidating the same to form the desired wear and fracture resistant surface, the first application method can be practiced sintering/consolidating the preformed green part prior to being applied onto the desired substrate. An example of such application method involves preforming a green part, e.g., a cap, from a desired composite cermet and/or cermet material as described above, and ROCing the preformed part prior to its placement on the substrate. The pre-consolidated cap is then placed over and attached to the intended substrate surface by brazing process with an appropriate brazing material, e.g., a silver-copper braze.

An advantage of this first method of preforming a green part, e.g., a cap, for subsequent formation of the desired wear and fracture resistant surface is that it does not involve the application method of welding as used with conventional hardfacing to apply conventional hardmetal materials. The avoidance of welding application of the wear and fracture resistant material eliminates the potential for unwanted material microstructure interruptions, caused by the introduction of welding byproducts into the material and welding related thermal effects, which are known sources of material failures due to cracking, chipping and fracture.

An additional advantage of this first method of applying is that it enables production of a wear and fracture resistant material layer thickness that is both reproducible and dimensionally accurate and consistent, thereby helping to reduce or eliminate accelerated wear failures due to surface layer thickness deviations.

According to a second application method, the desired composite cermet and/or cermet material is applied to a desired rock bit substrate in the form of a liquid slurry by dip, spray, or coating process. Like the first method described above, the second method can be achieved by using one or more liquefying agents for purposes of forming a solution from one or more composite material constituent material powders. An example second application method involves slurry coating, whereby a liquefying agent in the form of one or more different polymers or organic binders is used to aid in preparing a solution or slurry useful for forming a green part, e.g., for forming a coating onto an identified substrate surface.

The use of a polymer binder is desired as it introduces flexibility into the process of making a green part by enabling formation of a semi-plastic solution that can either be spray applied or dip applied onto the substrate surface to form a desired wear resistant composite material coating having an accurately controllable layer thickness. For example, polymer-assisted forming enables the application of composite material coatings having a repeatable layer thickness within a coating range of from 0.05 to 10 mm, and more preferably in the range of from about 0.2 to 2 mm. Again, as discussed above with respect to the first application method, it is to be understood that the layer thickness may vary from this range depending on such factors as the type of composite cermet and/or cermet materials selected, the location of the wear resistant material surface on the rock bit, and the particular rock bit drilling application.

Slurry coating involves the process of: (1) combining a desired material powder, e.g., constituent composite cermet and/or cermet powder like WC grains and Co powder, or WC—Co powder, with a polymer binder; (2) mixing the material powder and polymer binder together to form a semi-plastic solution; and (3) applying the solution to a desired substrate surface by dip, spray, brush, or roll technique.

Once the substrate surface is coated with the composite material solution, the so-formed green part is then consolidated by pressure assisted sintering process as described above to form the final dense product that provides the desired properties of wear and fracture resistance. In a preferred embodiment, the green part formed according to this second method is consolidated by the ROC process.

Advantages of these application methods, in addition to those discussed above, is that they can be used to provide a green surface on a variety of differently configured, i.e., planar or nonplanar, coatable substrate surfaces formed from a variety of different materials such as cermets, carbides, nitrides, carbonitrides, borides, steel, and mixtures thereof. Another advantage of using the slurry coating method is that it provides a consistent and accurately reproducible method for achieving a desired wear resistant composite material thickness via single or multiple coatings. This in turn provides a wear and fracture resistant rock bit surface having a dimensionally accurate and repeatable layer thickness, thereby reducing or eliminating altogether material wear failures related to material thickness inconsistencies associated with conventional welding techniques.

Functionally-engineered wear and fracture resistant surfaces, prepared according to principles of this invention, can be further processed by heat treatment to achieve certain physical/mechanical properties to adapt the finished product for use in a particular application.

Rock bits having functionally-engineered wear and fracture resistant surfaces, prepared according to first embodiment of this invention, can have a surface layer thickness in the range of from 0.5 to 10 mm. It is to be understood that the exact surface layer thickness will vary within this range depending on the choice of composite material, the rock bit substrate, and the rock bit application.

A first embodiment milled tooth bit, comprising a functionally-engineered wear and fracture resistant composite cermet material surface of this invention, is better understood with reference to the following examples.

EXAMPLE NO. 1

Rock Bit with WC—Co/Steel Functionally-Engineered Wear and Fracture Resistant Composite Cermet Surface A wear and fracture resistant composite cermet material solution is prepared by combining approximately 65 percent by weight WC—Co pellets, 35 percent by weight steel powder, and approximately 45 percent by volume paraffin wax and polypropylene. The ingredients are mixed together using a ball mill or other mechanical mixing means. If desired, additional solvents or other types of processing additives, such as lubricants or the like, can be used to aid in the processability of the solution to control solution viscosity and/or to control desired coating thickness. The resulting solution has a semi-fluid consistency.

The solution is further formed into a shape suitable for placement over a surface portion of a rock bit. In this example the solution is preformed by the thermoforming process described above into the shape of a cap suited for placement over a surface of a milled tooth. The so-formed green part is debinded and presintered at a temperature in the range of from about 800 to 1,100 C. for a period of about 30 to 40 minutes. The debinded green part is applied onto the intended rock bit surface and is sintered/consolidated by the ROC process as described above. The so-formed surface has a composite cermet material microstructure comprising a plurality of cermet first regions made of WC—Co granules that are distributed within a matrix second region made of steel. The composite cermet surface comprising such material microstructure provides improved properties of wear and fracture resistance when compared to conventional hardmetal materials applied by hardfacing method, i.e., by welding.

EXAMPLE NO. 2

Rock Bit with WC—Co/Cobalt Functionally-Engineered Wear and Fracture Resistant Composite Cermet Surface A wear resistant composite cermet material solution is prepared by combining approximately 65 percent by weight WC—Co pellets, 35 percent by weight cobalt powder, and approximately 45 percent by volume paraffin wax and polypropylene. The ingredients are mixed together using a ball mill or other mechanical mixing means. If desired, additional solvents or other types of processing additives, such as lubricants or the like, can be used to aid in the processability of the solution to control solution viscosity and/or to control desired coating thickness. The resulting solution has a semi-fluid consistency.

The solution is further formed into a shape suitable for placement over an intended surface portion of a milled tooth rock bit. In this example, the solution is preformed by the thermoforming process described above into the shape of a cap suited for placement over a surface of a milled tooth. The so-formed green part is debinded and presintered at a temperature in the range of from about 800 to 1,100 C. for a period of about 30 to 40 minutes. The debinded green part is placed over the intended rock bit surface and is sintered/consolidated by the ROC process as described above. The so-formed surface has a composite cermet material microstructure comprising a plurality of cermet first regions made of WC—Co granules that are distributed within a matrix second region made of cobalt. The composite cermet surface comprising such material microstructure provides improved properties of wear and fracture resistance when compared to conventional hardmetal materials applied by hardfacing method, i.e., by welding.

Figure 6:
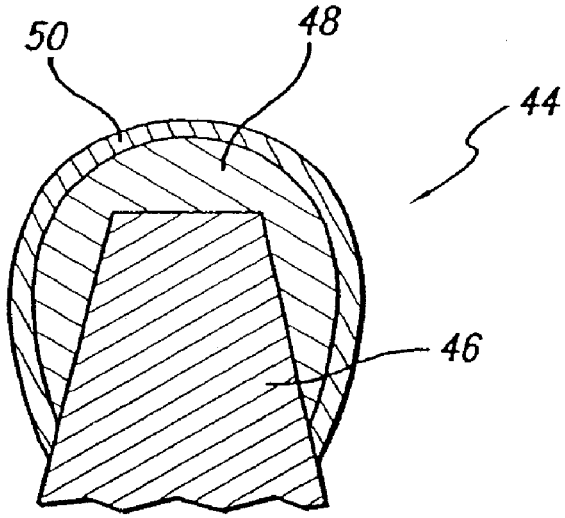
FIG. 6 is a cross sectional side view of a tooth comprising a wear and fracture resistant material surface according to second and fourth embodiments of this invention.

FIG. 6 illustrates a functionally-engineered wear and fracture resistant surface constructed according to a second embodiment of this invention 44 comprising a steel tooth substrate 46, taken from a milled tooth rock bit (such as that illustrated in FIG. 1), having a composite cermet material layer 48 disposed onto a surface of the steel tooth 46, and cermet material layer 50 disposed onto a surface of the composite cermet layer 48 that forms a final wear and fracture resistant milled tooth surface.

In such second invention embodiment, the composite cermet material layer 48 is selected from the same type of wear and fracture resistant materials discussed above for the first invention embodiment. The composite cermet material layer 48 can be formed/applied in the same manner as discussed above. In a preferred embodiment, the composite cermet material layer 48 is prepared according to the first method in the form of a preformed green part, e.g., a cap.

Figure 7:
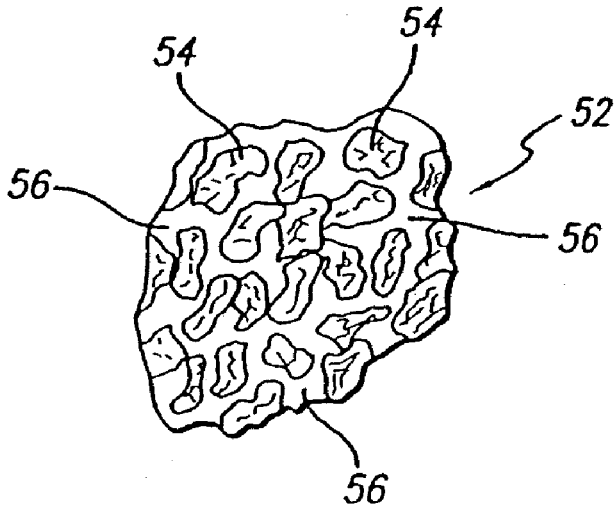
FIG. 7 is a schematic representation of a material microstructure for a wear and fracture resistant cermet material surface according to principals of this invention.

In such second invention embodiment, the cermet material layer 50 is formed from a cermet material. Referring to FIG. 7, example cermet materials suitable for forming wear and fracture resistant surfaces comprise a material microstructure 52 including a plurality of hard phase regions 54, that are bonded together by a softer or more ductile binder region 56. The hard phase regions 54 each comprises a plurality of hard particles that can include those formed from carbides, borides, nitrides, or carbonitrides that include a refractory metal such as W, Ti, Mo, Nb, V, Hf, Ta, and Cr. Example particles useful for forming the hard phase regions include WC, TiC, TaC, $TiB_2$, or $Cr_2C_3$. The binder region 56 can be formed from the group of ductile materials including one or a combination of Co, Ni, Fe, which may be alloyed with each other or with C, B, Cr, Si and Mn. Example cermet materials useful for forming the wear and fracture resistant cermet surface of this invention include WC—Co, WC—Ni, WC—Fe, WC—(Co, Ni, Fe) and their alloys.

In a preferred embodiment, the cermet material is WC—Co having a material microstructure comprising hard phase regions 54 of tungsten carbide (WC) grains, and a softer or more ductile binder phase region 56 of cobalt (Co) that bonds the WC grains to one another. In an example embodiment, the WC—Co cermet material may comprise less than about 20 percent by weight cobalt, and more preferably, in the range of from about 6 to 16 percent by weight cobalt. In a particular example, the WC—Co material comprises approximately 10 percent by weight cobalt. Preferred WC—Co materials have a WC grain size in the range of from about one to ten micrometers, and can have a Ra hardness in the range of from about 85 to 95, a fracture toughness in the range of from about 9 to 20 $MPaCm^{-1/2}$, and have a wear number in the range of from about 1.5 to 40 (1,000 rev/$cm^3$).

The cermet material can be applied to the surface of the underlying composite cermet layer by the same methods discussed above for the first embodiment. For example, the cermet material can be preformed into a green part, e.g., a cap, that is configured for placement over the composite cermet material layer. Alternatively, the cermet material can be applied to the composite cermet material in the form of a coating, e.g., by dip or spray application.

If desired, the composite cermet and cermet materials discussed above can each additionally include cast carbide particles, carburized WC powder, and/or microcrystalline tungsten carbide particles.

The unique properties of cemented tungsten carbide, e.g., toughness, wear and fracture resistance, result from the combination of a rigid carbide network with a tougher metal substructure. These cermet materials comprise a high density of hard phase regions when compared to conventional hardmetal material that are applied by hardfacing method. For example, such cermet materials have a high carbide density, and a reduced mean free path (MFP) between cermet particles or grains of less than about 10 micrometers when compared to conventional hardmetal materials applied by hardfacing method. This relatively high carbide density serves to resist preferential material loss of the ductile phase region, when compared to the lower carbide density conventional hardmetal materials, thereby serving to resist preferential wear of the ductile phase region and increase rock bit service life.

In this second embodiment the cermet material layer is applied to the underlying composite cermet material to provided an enhanced degree of wear resistance thereto. Although the composite cermet material layer has a level of wear resistance that is sufficient for most rock bit drilling applications, there are some extreme drilling applications that call for an even greater level of wear resistance. The cermet material layer is provided in such instances to protect the underlying composite cermet material layer from such extreme drilling applications, thereby serving to enhance the service life of the rock bit.

The composite cermet material layer has a relatively higher level of toughness than that of the cermet material layer. Thus, the composite cermet material layer serves in this second invention embodiment to control crack initiation and propagation caused from impact stresses transmitted to the cermet material layer, thereby also acting to enhance rock bit service life. Additionally, since the composite cermet material layer comprises a material microstructure having a larger proportion of metal than that of the cermet material layer, it serves as a thermally compatible intermediate layer between the steel substrate and largely carbide-containing cermet material to reduce the propensity for unwanted thermal stress cracking to develop in the cermet material layer. This too serves to increase the service life of the rock bit comprising both material layers.

In a preferred second embodiment, functionally-engineered wear and fracture resistant milled tooth bit surface comprises a composite cermet material layer 48 having a material microstructure as discussed above including a plurality of carbide (e.g., WC—Co) granules distributed within a matrix binder material phase (e.g., steel or cobalt), and cermet material layer 50 having a material microstructure as discussed above including a plurality of carbide grains (e.g., WC) bonded together by a ductile binder metal (e.g., cobalt). In this preferred embodiment, the two material layers are functionally engineered to provide a high level of wear resistance at the rock bit surface (by presence of the high carbide density cermet material) with an increased degree of toughness below the surface (by the presence of the composite cermet material) to control the initiation and propagation of cracks.

While the coated rock bit substrate illustrated in FIG. 6 is a milled tooth, it is to be understood that wear resistant composite materials of this invention can be disposed on other surface portions of the rock bit depending on the particular bit application, e.g., onto a surface of the rotary cone, as described above.

Each material layer 48 and 50 can be sintered/consolidated, e.g., by ROC process, independently, or all of the layers can be applied and then sintered/consolidated in a single step, e.g., by a single ROC process as described in Example No. 3.

Rock bits with functionally-engineered wear and fracture resistant material surfaces, prepared according to a second embodiment of this invention, comprise a composite cermet material layer having a layer thickness of from about 0.5 to 10 mm, and a cermet material layer thickness of from about 0.2 to 2 mm.

It is to be understood that while a second embodiment of this invention has been disclosed above and illustrated in FIG. 6 as comprising two different composite material layers, second invention embodiments comprising more than two material layers are intended to be within the scope of this invention.

A second embodiment milled tooth bit, comprising a functionally-engineered wear and fracture resistant material surface of this invention, is better understood with reference to the following example.

EXAMPLE NO. 3

Rock Bit with WC—Co/Steel and WC—Co Functionally-Engineered Wear and Fracture Resistant Surface A preformed cap is prepared, according to the practice of Example No. 1, comprising a plurality of WC—Co granules distributed within a steel matrix. The green cap is debinded and presintered at a temperature in the range of from about 800 to 1,100 C. for a period of about 30 to 40 minutes. A wear resistant cermet material solution is prepared by combining in the range of from 30 to 90 percent by volume cermet constituent powder, e.g., WC powder and Co powder. The powder comprises approximately 10 percent by weight cobalt. The remaining volume of the coating solution is polymer binder. In a preferred embodiment, in the range of from 50 to 75 percent by volume of WC and Co powder is used. In an example embodiment, the polymer binder solution comprises approximately 20 percent by weight poly-propylcarbonate in methyl ethyl ketone (MEK) solution. The embodiment can use binder solutions containing from 5 to 50 weight percent polymer in solution. Moreover, solvents other than MEK may be utilized.

The polymer binder solution is combined with the material powder element and the ingredients are mixed together using a ball mill or other mechanical mixing means. If desired, additional solvents or other types of processing additives, such as lubricants or the like, can be used to aid in the processability of the solution to control solution viscosity and/or to control desired coating thickness. The resulting solution has a semi-fluid consistency.

The outside surface of the green composite cermet cap is dipped into the cermet solution for a period of time that will vary depending on the make-up of the solution. In the example embodiment, where binder comprises MEK present in the above-identified proportions, the cap is dipped into the solution for a period of approximately 5 seconds. The dipped surface is removed from the solution and allowed to dry for a period of time, e.g., in the example embodiment, approximately 1 minute. Again, drying time is understood to vary depending on the particular solution make up.

The dipped cap is placed onto a milled tooth and is sintered/consolidated by the ROC process as described above to provide a functionally-engineered wear and fracture resistant surface disposed over at least a portion of the tooth having a carbide grain MFP of less than 10 micrometers, and displaying improved properties of wear and fracture resistance when compared to a conventional hardmetal materials applied by hardfacing method.

FIG. 3 can also be used to illustrate a functionally-engineered wear and fracture resistant surface constructed according to a third embodiment of this invention, wherein the composite cermet material 24 described in the first invention embodiment is replaced with a cermet material similar to that described above and illustrated in FIG. 6 that is used to form the surface layer 50 in the second invention embodiment. Thus, in this third invention embodiment the wear and fracture resistant surface is formed from a cermet material.

The cermet material selected to form the third embodiment wear and fracture resistant surface can be formed from the same types of cermet materials described above, and has the same material microstructure as described above and illustrated in FIG. 7. However, because the cermet material is placed in direct contact with the underlying steel substrate, i.e., there is no intermediate composite cermet material layer, it is desired that the cermet material have a relatively higher metal content than the cermet material layer used to form a wear and fracture resistant layer over the composite cermet material. A higher metal content is desired to improve the thermal compatibility between cermet material and the steel substrate.

In an example embodiment, cermet materials useful for forming a wear and fracture resistant surface, according to a third embodiment of this invention, may comprise in the range of from about 10 to 40 percent by volume metal. In a preferred embodiment, the cermet material is WC—Co comprising approximately 15-40 percent by volume cobalt.

Wear and fracture resistant surfaces of this third invention embodiment can be formed and applied to an underlying rock bit substrate according to the same application methods described above, e.g., in the form of a preformed cap by thermoforming process, or in the form of a dip or spray applied coating by polymer-assisted forming process. The method for making and applying the cermet material will depend on such factors as the type of cermet material selected, the position of the cermet material on the rock bit, and the particular drilling application. Generally speaking, the cermet material can be made and applied in the form of a preformed cap when seeking to form a surface layer having a thickness of above about 0.5 mm, and is applied in the form of a dip or spray coating when seeking to form a surface layer having a thickness below about 0.5 mm. In a preferred embodiment, the cermet surface layer is formed and applied by slurry coating method and has a material layer thickness of approximately 3 mm. The green surface layer is sintered and consolidated by ROC process as described above.

Wear and fracture resistant surfaces prepared according to this third embodiment can be useful in abrasive wear situations calling for a surface layer having a relatively more uniform material microstructure, where uprooting of hard phase grains is not of major concern, and the fracture toughness provided by such cermet materials is sufficient.

FIG. 6 can also be used to illustrate a functionally-engineered wear and fracture resistant surface constructed according to a fourth embodiment of this invention, wherein the composite cermet material layer 48 (described in the second invention embodiment) is replaced with the relatively high metal content cermet material (identical to that described above for the third invention embodiment). The material layer forming the surface of this fourth embodiment is formed from the same high-carbide density cermet material used to form the surface layer 50 in the second invention embodiment. Thus, this fourth invention embodiment comprises a dual cermet material layer construction having a surface layer formed from a cermet material having a reduced MFP between carbide particles when compared to conventional hardmetal material applied by hardfacing method.

Use of the relatively high metal content cermet material as the intermediate material layer in this embodiment, when compared to use of the composite cermet material in the second embodiment, is intended to provide an improved degree of wear resistance to the construction, and is useful in certain applications where properties of toughness in the intermediate layer is not as important as wear resistance. Like the use of the composite cermet material as an intermediate layer in the second invention embodiment, use of the relatively high metal content cermet material also serves to improve the thermal compatibility between the underlying steel substrate and the adjacent cermet material, thereby helping to control thermal related stresses.

In an example embodiment, the relatively high metal content cermet material is WC—Co comprising approximately 15 to 40 percent by volume cobalt, and the cermet material forming the surface layer is WC—Co comprising approximately 15 percent by volume cobalt.

The cermet material layers used in this fourth invention embodiment can be formed from cermet materials and applied to an underlying substrate according to the same methods described above, e.g., in the form of a preformed cap by thermoforming process, or in the form of a dip or spray applied coating by polymer-assisted forming: process. The method that is ultimately chosen will depend on such factors as the types of cermet materials selected, the position of the cermet materials on the rock bit, and the particular drilling application.

As discussed above, the cermet materials can be made and applied in the form of a preformed cap when seeking to form a material layer having a thickness of above about 0.5 mm, and can be applied in the form of a dip or spray coating when seeking to form a material layer having a thickness below about 0.5 mm. In a preferred embodiment, the fourth invention embodiment is prepared by preforming the relatively high metal content cermet material into a cap having a thickness of approximately 3 mm and configured to fit over a milled tooth, and the cermet material forming the surface layer is applied in the form of a coating onto the cap, having a thickness of approximately 0.5 mm, prior to its installation over the bit substrate. The green material layers are sintered and consolidated by ROC process as described above.

Figure 8:
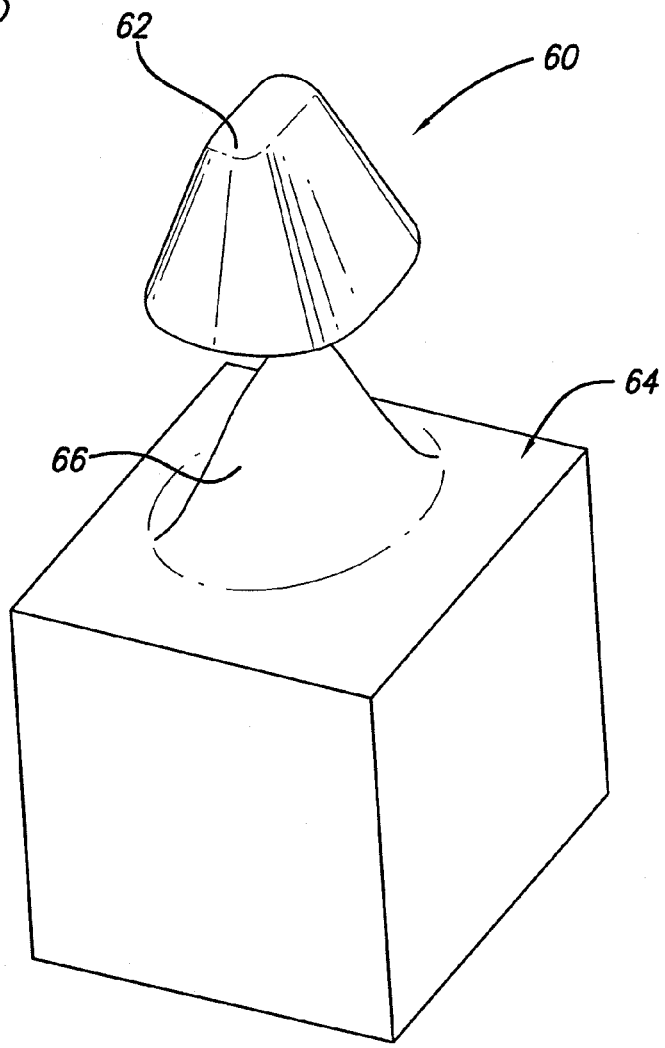
FIG. 8 is a perspective view of a tooth cap embodiment of this invention mounted over a portion of a milled tooth.
Figure 9:
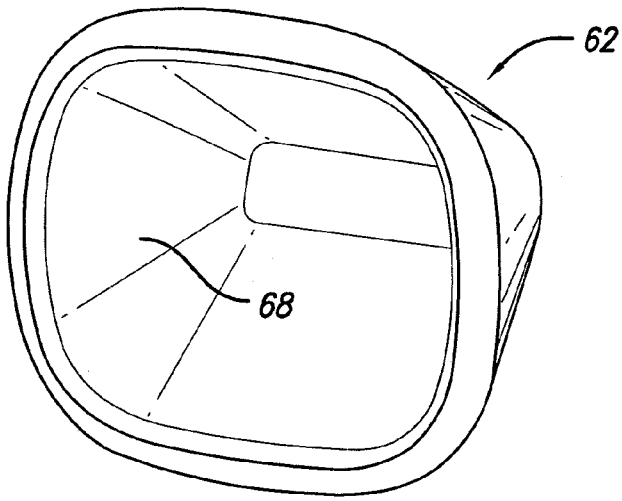
FIG. 9 is a perspective view of the tooth cap embodiment of FIG. 8.

FIGS. 8 and 9 illustrate an embodiment of milled tooth bit wear and fracture resistant surfaces of this invention provided in the form of a preformed cap. Specifically, FIG. 8 illustrates a wear and fracture resistant surface embodiment 60 comprising a cap 62 that is configured for placement over a portion of an underlying milled tooth bit substrate 64. In this example embodiment, the substrate comprises a portion of a milled tooth 66. The cap is formed according to any one of the cap forming methods described above and is configured having an inside cavity 68 that is sized and shaped to fit over the milled tooth 66. As noted above, the cap 62 can either be attached to the milled tooth by brazing, when provided as a presintered part, or by sintering, when provided as a green-state part.

FIGS. 10 to 12 illustrate another embodiment 70 of milled tooth bit wear and fracture resistant surfaces of this invention provided in the form of a tooth portion 72 that is configured for placement over a portion of an underlying milled tooth bit substrate 74. Specifically, the tooth portion 72 is sized and shaped to itself form a projecting portion of the milled tooth, comprising leading and trailing leading and trailing face surfaces 78 and 80 forming a crown surface 82 at the tooth tip. The tooth portion 72 additionally includes axial surfaces 84 and 86 interposed between the faces surfaces 78 and 80.

A feature of the tooth portion embodiment of this invention is that it is substantially solid part provides a structural portion of the tooth structure itself. For this reason, tooth portion embodiments of this invention can be thought of as being an tooth implant. Tooth implants of this invention include means 88, positioned along a milled tooth bit engaging surface portion of the tooth opposite from the crown, configured to permit attachment with a adjacent portion of the milled tooth bit substrate 74. As best shown in FIG. 12, such attaching means 88 can be in the form of a projecting member or the like that is sized and shaped for placement within a cooperating attachment means in the milled tooth bit.

FIG. 11 illustrates that the milled tooth bit substrate 74 for this embodiment comprises a raised portion 90, forming a base portion of the milled tooth, and the raised portion includes an attachment means 94 for receiving the attachment means 88 of the milled tooth 72. In this particular embodiment, the attachment means 94 is provide in the form of a recess disposed a desired depth into substrate 74 from a tooth portion interface surface 92. The recess 94 is sized and shaped to accommodate placement of the tooth projecting member 88 therein. In this particular embodiment, the tooth projecting member 88 is in the form of a round peg, and the bit substrate attachment means 94 is provided in the form of a round recess.

While particular tooth and substrate attachment members have been described and illustrated, it is to be understood that many other attachment member configurations are possible, and that a common underlying principal is that the two attachment members be configured to provide a complementary fit with one another. Accordingly, if desired, the substrate can have a projecting attachment member and the tooth can have a recess for accommodating placement of the projecting member therein.

The tooth portion or tooth implant described above 74 can be formed from the same wear and fracture resistant materials, and in the same manner, as described above for the cap embodiment. For example, the tooth portion 72 can be provided as a green part that is molded into the desired milled tooth configuration. The green part can either be attached to the milled tooth substrate and then sintered thereto to provide the desired wear and fracture resistant milled tooth bit surface, or can be sintered prior to attachment with the milled tooth substrate and be attached thereto by brazing process to provide the desired final wear and fracture resistant milled tooth bit substrate. Additionally, the tooth portion can be configured having different composite material layers as described above.

In a preferred embodiment, the tooth portion 72 is shaped into a solid preform having an external geometry similar to a standard milled tooth. The preform is consolidated using either sinter-HIP (carbide) or ROC (DC Carbide) process. The underlying milled tooth bit substrate is configured to provide a desired braze gap, e.g., in a preferred embodiment of approximately 0.12 thick. The tooth portion is attached to the underlying milled tooth bit substrate by high temperature brazing at approximately 830 C.

FIGS. 13 to 15 illustrate another embodiment 96 of milled tooth bit wear and fracture resistant surfaces of this invention similar to that described above and illustrated in FIGS. 10 to 12, provided in the form of a tooth portion 98 that is configured for placement over a portion of an underlying milled tooth bit substrate 100. Unlike the embodiment illustrated in FIGS. 10 to 12, the tooth portion 98 includes a substrate interfacing surface 102 that does not include a projecting member. Rather, both the tooth portion substrate interfacing surface 102 and the substrate tooth interfacing surface 104 are substantially planar to facilitate cooperative placement of the tooth portion thereon. This tooth portion embodiment is formed in the same manner described above for the tooth portion embodiment illustrated in FIGS. 10 to 12.

FIGS. 16 to 18 illustrate another embodiment 106 of milled tooth bit wear and fracture resistant surfaces of this invention similar to that described above and illustrated in FIGS. 10 to 12, provided in the form of a tooth portion 108 that is configured for placement over a portion of an underlying milled tooth bit substrate 110. Unlike the embodiment illustrated in FIGS. 10 to 12, the tooth portion 108 is configured to form substantially the entire portion of the tooth such that the tooth implant 108 includes a base portion 112 positioned adjacent a flat portion of the milled tooth bit.

The tooth portion 108 of this particular embodiment also includes a recessed section 114 that extends a depth within the tooth from the base 112. The recessed section 114 is sized and shaped to accommodate placement of a milled tooth bit substrate raised portion 116. The tooth recessed section 114 can be centrally positioned relative to the base 112, or can be offset depending on the particular substrate configuration. This tooth portion embodiment is formed in the same manner described above for the tooth portion embodiment illustrated in FIGS. 10 to 12.

Figure 19:
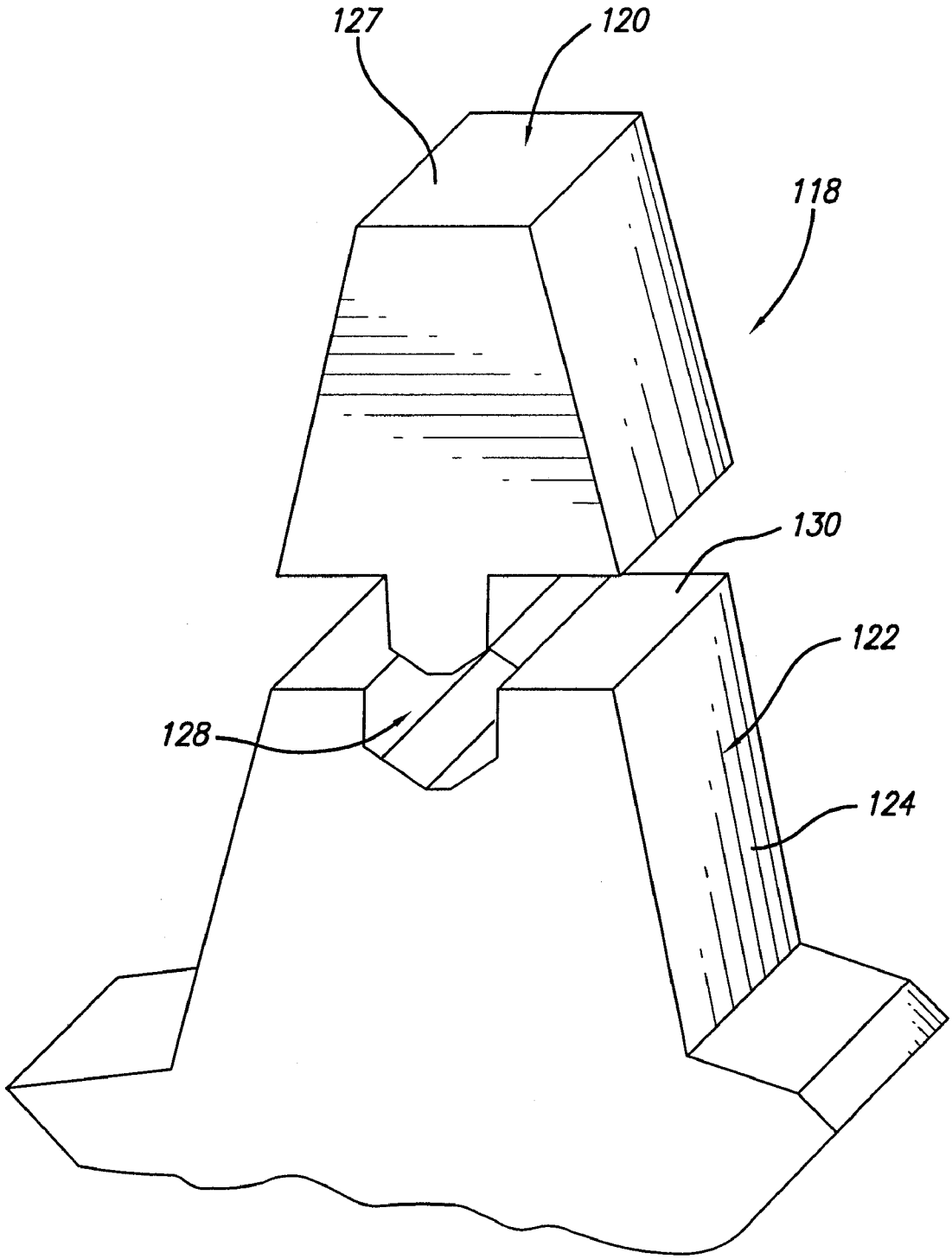
FIG. 19 is a perspective view of still another tooth implant embodiment of this invention mounted to a portion of a milled tooth rock bit.

FIGS. 19 and 20 illustrate another embodiment 118 of milled tooth bit wear and fracture resistant surfaces of this invention similar to that described above and illustrated in FIGS. 10 to 12, provided in the form of a tooth portion 120 that is configured for placement over a portion of an underlying milled tooth bit substrate 122. Similar to the embodiment reference, the tooth portion 120 of this embodiment is configured to form a portion of the bit tooth, and is disposed onto a milled tooth bit substrate 122 configured having a projecting section 124 that forms a base portion of the tooth.

The tooth portion 120 of this embodiment include an attachment member 126 projecting from a surface of the tooth opposite the crown 127 that is configured to complement an attachment recess 128 disposed within a tooth interface surface 130 of the substrate 122. In an example embodiment, the two attachment members provide a tongue-in-groove type attachment mechanism. In a preferred embodiment, the tooth attachment member 126 is provided having a pultruded surface characterized by angular surface, and the attachment recess 128 is configured having a complementary configuration, to provide an enhanced attachment surface interface therebetween. If desired, the attachment member and attachment recess can be sized to provide a desired interference pressed fit to complement brazed attachment therebetween. This tooth portion embodiment is formed in the same manner described above for the tooth portion embodiment illustrated in FIGS. 10 to 12.

Rock bits having wear and fracture resistant surfaces formed from functionally-engineered composite cermet and/or cermet materials according to the methods described herein and illustrated provide the following advantages when contrasted with a conventional hardfacing formed from conventional hardmetal material: (1) they provide a consistent and uninterrupted material microstructure that does not suffer from the unwanted effects of weld applying the material, e.g., the introduction of unwanted material contaminants and thermal stress-related cracks into the material microstructure; (2) they provide a surface layer or a surface feature having that is functionally engineered to control/resist the preferential wear and material loss of the materials forming the surface layer or feature; and (3) they provide an ability to achieve a reproducible and dimensionally accurate and consistent surface layer or surface feature thickness.

As a result of these advantages, rock bits surfaces having wear and fracture resistant composite cermet and/or cermet material surfaces of this invention provide improved properties of wear and fracture resistance when compared to rock bit surfaces protected by hardfacing formed from conventional hardmetal materials, thereby increasing the resulting service life of rock bits comprising the same.

Other modifications and variations of rock bit surfaces formed from wear and fracture resistant composite cermet and/or cermet materials will be apparent to those skilled in the art. It is, therefore, to be understood that within the scope of the appended claims, this invention may be practiced otherwise than as specifically described.

What is claimed is:

1. A bit for drilling subterranean formations comprising:

a steel bit body comprising a number of cutting elements extending from the bit wherein one or more of the cutting elements comprises a steel base portion projecting outwardly a distance, and a substantially solid end portion attached to the base and extending therefrom forming a tip of the cutting element, the end portion formed from a wear resistant material having a microstructure comprising a first phase of grains selected from the group consisting of carbide, borides, nitrides, and carbonitrides of W, Ti, Mo, Nb, V, Hf, Ta and Cr refractory metals, and a second phase of a binder material selected from the group consisting of Co, Ni, Fe and alloys thereof, wherein a braze material is interposed between and attaching the end portion to the steel base element, wherein the cutting element base includes a recessed opening along a top surface, and wherein the end portion includes a projection that extends from a bottom surface and that is disposed in the recessed opening.

2. The bit as recited in claim 1 wherein the end portion comprises two or more layers of different materials.

3. The bit as recited in claim 1 wherein the wear resistant surface comprises cemented tungsten carbide.

4. The bit as recited in claim 1 wherein the cutting element base has leading and trailing face surfaces that are tapered, and wherein the end portion has leading and trailing surfaces that are tapered in the same amount as the cutting element base.

5. A rotary cone bit comprising:

a steel bit body comprising at least one leg extending therefrom;

a steel cone rotatably disposed on the leg; and p1 a plurality of teeth projecting outwardly away from the cone, at least one tooth comprising a steel base portion integral with the cone and projecting a distance therefrom, and a substantially solid end portion extending from the base portion to form a tip of the tooth, the end portion being formed from a wear resistant material having a microstructure comprising:

a first phase of grains selected from the group of carbides, borides, nitrides, and carbonitrides of W, Ti, Mo, Nb, V, Hf, Ta, and Cr refractory metals; and a second phase of a binder material selected from the group consisting of Co, Ni, Fe, and alloys thereof;

wherein the end portion is attached to the base portion by a braze material interposed therebetween; and wherein the base includes a recessed opening along a top surface, and wherein the end portion includes a projection that extends from a bottom surface and that is disposed in the recessed opening.

6. The bit as recited in claim 5 wherein the wear resistant composite material is WC-Co.

7. A method for making a tooth construction for use with a bit for drilling subterranean formations, the method comprising the steps of:

combining powders selected from the group consisting of carbides, borides, nitrides, carbonitrides, refractory metals, cermets, Co, Fe, Ni, steel, and combinations thereof to form a material mixture;

shaping the material mixture into the form of an end portion of the cutting element, wherein the cutting element includes a rigid preformed steel base that is integral with and that projects outwardly a distance from the bit, the end portion being substantially solid and configured to extend from an interface surface of the steel base to define a tip of the tooth construction;

pressurizing the end portion under conditions of elevated temperature to sinter the shaped material mixture to form the wear resistant material; and attaching the end portion to the base by welding, wherein the base includes a recessed opening along a top surface, and wherein the end portion includes a projection that extends from a bottom surface and that is disposed in the recessed opening.

* * * * *